US008200135B2

(12) United States Patent
Fujita et al.

(10) Patent No.: US 8,200,135 B2
(45) Date of Patent: Jun. 12, 2012

(54) TRANSFER-FIXING DEVICES WITH HEATING AND TEMPERATURE EQUALIZING CAPABILITIES, AND APPARATUSES AND METHODS USING THE SAME

(75) Inventors: Takashi Fujita, Kanagawa (JP); Shin Kayahara, Kanagawa (JP); Hiromitsu Takagaki, Kanagawa (JP); Takashi Seto, Kanagawa (JP); Takeshi Takemoto, Kanagawa (JP); Hirohmi Tamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 596 days.

(21) Appl. No.: 12/071,070

(22) Filed: Feb. 15, 2008

(65) Prior Publication Data

US 2008/0199229 A1 Aug. 21, 2008

(30) Foreign Application Priority Data

Feb. 15, 2007 (JP) ..... 2007-034971

(51) Int. Cl.
*G03G 15/00* (2006.01)

(52) U.S. Cl. ..... 399/307

(58) Field of Classification Search ..... 399/307, 399/308, 335, 320, 329, 338
See application file for complete search history.

(56) References Cited

U.S. PATENT DOCUMENTS

| | | | | |
|---|---|---|---|---|
| 4,365,139 | A * | 12/1982 | Dannatt | 219/216 |
| 4,455,079 | A * | 6/1984 | Miwa et al. | 399/308 |
| 5,402,220 | A * | 3/1995 | Tanaka et al. | 399/68 |
| 5,568,240 | A * | 10/1996 | Ohtsuka | 399/335 |
| 5,933,694 | A | 8/1999 | Yamashita et al. | |
| 6,175,713 | B1 * | 1/2001 | Uehara et al. | 399/307 |
| 7,031,648 | B2 | 4/2006 | Takashi et al. | |
| 7,127,202 | B2 | 10/2006 | Fujita et al. | |
| 7,233,762 | B2 | 6/2007 | Kunii et al. | |
| 7,257,702 | B2 | 8/2007 | Yamada et al. | |
| 7,299,003 | B2 | 11/2007 | Kurotaka et al. | |
| 2002/0118982 | A1 | 8/2002 | Fuma | |
| 2004/0037595 | A1 | 2/2004 | Takashi et al. | |
| 2005/0025534 | A1 | 2/2005 | Fujita et al. | |
| 2005/0078990 | A1 * | 4/2005 | Shiraishi | 399/329 |
| 2005/0152722 | A1 * | 7/2005 | Tawada et al. | 399/346 |

(Continued)

FOREIGN PATENT DOCUMENTS

JP 57-164773 10/1982

(Continued)

OTHER PUBLICATIONS

European Search Report dated Aug. 4, 2008 for counterpart European Application No. 08151387.1-2209.

(Continued)

*Primary Examiner* — David Gray
*Assistant Examiner* — Billy J Lactaoen
(74) *Attorney, Agent, or Firm* — Harness, Dickey & Pierce, P.L.C.

(57) ABSTRACT

A transfer-fixing device includes a transfer-fixing member, a pressing member, a heating device, and a temperature equalizer. The transfer-fixing member carries the toner image. The pressing member presses against the transfer-fixing member to form a nip portion to which the recording medium is conveyed. The heating device heats the transfer-fixing surface of the recording medium conveyed toward the nip portion. The temperature equalizer equalizes a temperature distribution of a surface of the transfer-fixing member in a width direction of the transfer-fixing member after the surface of the transfer-fixing member passes through the nip portion.

20 Claims, 4 Drawing Sheets

U.S. PATENT DOCUMENTS

| | | | | |
|---|---|---|---|---|
| 2005/0201783 | A1 | 9/2005 | Kurotaka et al. | |
| 2005/0207801 | A1 | 9/2005 | Kunii et al. | |
| 2006/0115305 | A1* | 6/2006 | Lofthus et al. | 399/328 |
| 2006/0184780 | A1 | 8/2006 | Yamada et al. | |
| 2007/0012676 | A1 | 1/2007 | Koide et al. | |
| 2007/0065188 | A1 | 3/2007 | Takagaki et al. | |
| 2007/0071511 | A1 | 3/2007 | Suzuki et al. | |
| 2007/0212126 | A1 | 9/2007 | Seto et al. | |
| 2007/0212129 | A1 | 9/2007 | Takemoto et al. | |
| 2008/0008505 | A1 | 1/2008 | Seto et al. | |

FOREIGN PATENT DOCUMENTS

| | | |
|---|---|---|
| JP | 02-154285 | 6/1990 |
| JP | 09-160408 | 6/1997 |
| JP | 10-207588 | 8/1998 |
| JP | 2001-042665 | 2/2001 |
| JP | 2001-201978 | 7/2001 |
| JP | 2002-099159 | 4/2002 |
| JP | 2002-186179 | 6/2002 |
| JP | 2002-300329 | 10/2002 |
| JP | 2003-259043 | 9/2003 |
| JP | 2004-037999 | 2/2004 |
| JP | 2004-038545 | 2/2004 |
| JP | 2004-038546 | 2/2004 |
| JP | 2004-356822 | 12/2004 |
| JP | 2005-037879 | 2/2005 |
| JP | 2005-215224 | 8/2005 |
| JP | 2005-242085 | 9/2005 |
| JP | 2006-229509 | 8/2006 |

OTHER PUBLICATIONS

WO 2004-092934.

English abstract of WO 2004-092934, published Oct. 28, 2004.

Japanese Office Action corresponding to JP 2007-034971 dated Oct. 11, 2011.

* cited by examiner

TRANSFER-FIXING DEVICES WITH HEATING AND TEMPERATURE EQUALIZING CAPABILITIES, AND APPARATUSES AND METHODS USING THE SAME

PRIORITY STATEMENT

The present patent application claims priority from Japanese Patent Application No. 2007-034971 filed on Feb. 15, 2007 in the Japan Patent Office, the entire contents of which are hereby incorporated herein by reference.

BACKGROUND OF THE INVENTION

1. Field of the Invention

Example embodiments generally relate to a transfer-fixing device, an image forming apparatus, and a transfer-fixing method, for example, for transferring and fixing a toner image on a recording medium.

2. Description of the Related Art

A related-art image forming apparatus including a copying machine, a facsimile machine, a printer, or a multifunction printer having two or more of copying, printing, scanning, and facsimile functions, forms a toner image on a recording medium (e.g., a sheet) according to image data by an electrophotographic method.

For example, a charger charges a surface of a photoconductor. An optical writer emits a light beam onto the charged surface of the photoconductor to form an electrostatic latent image on the photoconductor according to the image data. A development device develops the electrostatic latent image with a developer (e.g., toner) to form a toner image on the photoconductor. The toner image is transferred from the photoconductor onto a recording medium via an intermediate transfer belt. A fixing device applies heat and pressure to the recording medium bearing the toner image to fix the toner image on the recording medium. Thus, the toner image is formed on the recording medium.

However, when a recording medium having a rough surface is used, the intermediate transfer belt may not fully conform to the surface of the recording medium, and consequently a minute gap is formed between the intermediate transfer belt and the recording medium. As a result, abnormal electrical discharge occurs at the gap, and the toner image carried by the intermediate transfer belt is not properly transferred to the recording medium, resulting in a faulty image.

To address this problem, there are examples of a related-art image forming apparatus including a transfer-fixing device for performing a transfer process and a fixation process at the same time. Since the transfer-fixing device transfers a toner image to a recording medium while applying heat to the toner image, heated toner particles are softened and melted into a viscoelastic block-like clot, and fixed to the recording medium. Even when a minute gap is formed between a recording medium with a rough surface and a transfer-fixing belt, the clotted toner is fixed into the gap, thereby forming a high-quality image.

However, since the toner image is heated and melted by heating the transfer-fixing belt carrying the toner image, heat efficiency of the transfer-fixing belt decreases when the transfer-fixing belt has increased thickness for extended life or has a longer perimeter for use in a large-sized tandem type image forming apparatus. As a result, the transfer-fixing device may consume an increased amount of energy.

In addition to the above heating process, the transfer-fixing device performs a cooling process for cooling the transfer-fixing belt after the transfer and fixing processes in order to mitigate thermal damage to an imaging device. Therefore, repeated heating and cooling may cause the transfer-fixing device to consume an increased amount of energy.

SUMMARY

At least one embodiment may provide a transfer-fixing device that includes a transfer-fixing member to carry the toner image, a pressing member to press against the transfer-fixing member to form a nip portion to which the recording medium is conveyed, a heating device to heat the transfer-fixing surface of the recording medium conveyed toward the nip portion, and a temperature equalizer to equalize a temperature distribution of a surface of the transfer-fixing member in a width direction of the transfer-fixing member after the surface of the transfer-fixing member passes through the nip portion.

At least one embodiment may provide an image forming apparatus that includes a transfer-fixing device to transfer a toner image to a transfer-fixing surface of a recording medium and fix the toner image on the recording medium. The transfer-fixing device includes a transfer-fixing member to carry the toner image, a pressing member to press against the transfer-fixing member to form a nip portion to which the recording medium is conveyed, a heating device to heat the transfer-fixing surface of the recording medium conveyed toward the nip portion, and a temperature equalizer to equalize a temperature distribution of a surface of the transfer-fixing member in a width direction of the transfer-fixing member after the surface of the transfer-fixing member passes through the nip portion.

At least one embodiment may provide a transfer-fixing method that includes carrying a toner image with a transfer-fixing member, forming a nip portion between the transfer-fixing member and a pressing member for pressingly contacting the transfer-fixing member, heating a transfer-fixing surface of a recording medium conveyed toward the nip portion formed between the transfer-fixing member and the pressing member, transferring the toner image from the transfer-fixing member to the heated transfer-fixing surface of the recording medium at the nip portion, fixing the toner image on the recording medium with heat and pressure applied to the recording medium at the nip portion, and equalizing a temperature distribution of a surface of the transfer-fixing member in a width direction of the transfer-fixing member after the surface of the transfer-fixing member passes through the nip portion.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
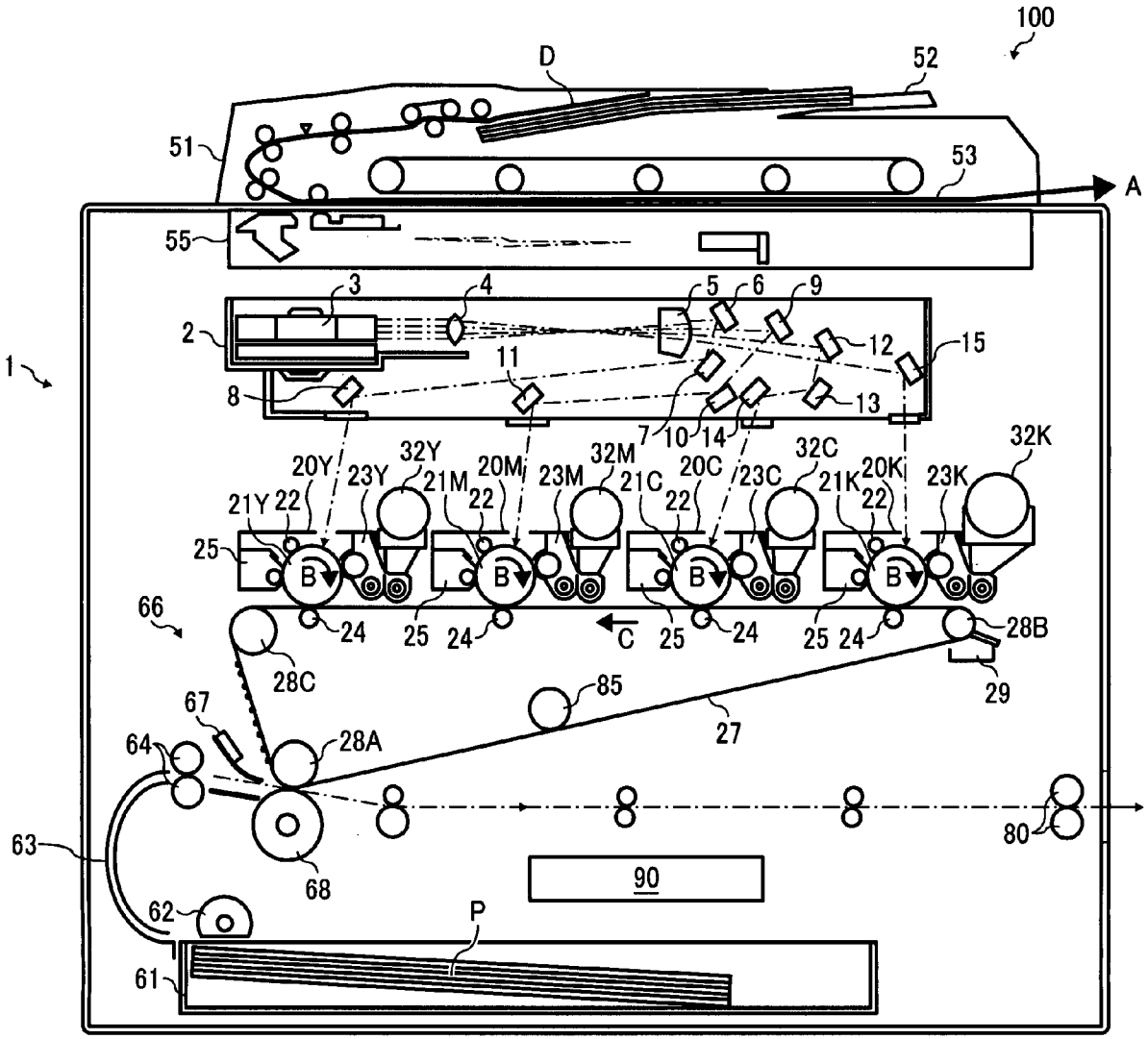
FIG. 1 is a schematic view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, in particular to FIG. 1, an image forming apparatus 100 according to an example embodiment of the present invention is described.

FIG. 1 illustrates a schematic view of the image forming apparatus 100 functioning as a color copying machine. The image forming apparatus 100 includes a body 1 and/or an original conveyance device 51. The body 1 includes an optical writer 2, process cartridges 20Y, 20M, 20C, and 20K, transfer bias rollers 24, toner suppliers 32Y, 32M, 32C, and 32K, an original reader 55, a paper tray 61, a feed roller 62, a conveyance guide 63, a registration roller pair 64, a transfer-fixing device 66, a discharge roller pair 80, and/or a controller 90. The original conveyance device 51 includes an original tray 52. The original reader 55 includes an exposure glass 53. The optical writer 2 includes a polygon mirror 3, lenses 4 and 5, and/or mirrors 6, 7, 8, 9, 10, 11, 12, 13, 14, and 15. The process cartridges 20Y, 20M, 20C, and 20K include photoconductors 21Y, 21M, 21C, and 21K, chargers 22, development devices 23Y, 23M, 23C, and 23K, and/or cleaners 25, respectively. The transfer-fixing device 66 includes a transfer-fixing belt 27, a heating device 67, a pressing roller 68, an equalizing roller 85, rollers 28A, 28B, and 28C, and/or a belt cleaner 29.

The following describes an operation of the image forming apparatus 100 forming a color image.

An original document D (hereinafter "original D") is conveyed from the original tray 52 by conveyance rollers (not shown) in a direction A and placed on the exposure glass 53 of the original reader 55. The original reader 55 optically reads an image on the original D.

More specifically, the original reader 55 emits light from an illumination lamp (not shown) onto the image formed on the original D placed on the exposure glass 53 to scan the image. Light reflected by the original D is transmitted to a color sensor (not shown) via mirrors (not shown) and a lens (not shown). The color sensor reads color image information of the image formed on the original D for each of RGB (red, green, and blue) colors and converts the image information into electrical image signals. Based on the image signals of RGB, an image processing device (not shown) performs color conversion processing, color correction processing, spatial frequency correction processing, and/or the like, and obtains color image information in yellow, magenta, cyan, and black.

The color image information in yellow, magenta, cyan, and black is transmitted to the optical writer 2. The optical writer 2 emits a laser beam (e.g., an exposure light) based on the color image information in each color to the photoconductors 21Y, 21M, 21C, and 21K of the corresponding process cartridges 20Y, 20M, 20C, and 20K, respectively.

As illustrated in FIG. 1, the photoconductors 21Y, 21M, 21C, and 21K rotate clockwise (e.g., in a direction B). In a charging process, the chargers 22 uniformly charge respective surfaces of the photoconductors 21Y, 21M, 21C, and 21K to form charged potentials thereon. The charged surfaces of the photoconductors 21Y, 21M, 21C, and 21K respectively move to positions irradiated by a laser beam.

In an exposure process, the optical writer 2 emits a laser beam for each color from a light source (not shown) based on the image signal. After being reflected by the polygon mirror 3, the laser beams are transmitted through the lenses 4 and 5, and pass through different light paths provided for yellow, magenta, cyan, and black color components.

The laser beam for the yellow component is reflected by the mirrors 6 through 8, and irradiates the surface of the photoconductor 21Y of the process cartridge 20Y. The polygon mirror 3 rotates at high speed to scan the laser beam for the yellow component in an axial direction (e.g., a main scanning direction) of the photoconductor 21Y. Accordingly, an electrostatic latent image for the yellow component is formed on the charged surface of the photoconductor 21Y.

Similarly, after the laser beam for the magenta component is reflected by the mirrors 9 through 11 and irradiates the surface of the photoconductor 21M of the process cartridge 20M, an electrostatic latent image for the magenta component is formed on the photoconductor 21M. Similarly, after the laser beam for the cyan component is reflected by the mirrors 12 through 14 and irradiates the surface of the photoconductor 21C of the process cartridge 20C, an electrostatic latent image for the magenta component is formed on the photoconductor 21C. Similarly, after the laser beam for the black component is reflected by the mirror 15 and irradiates the surface of the photoconductor 21K of the process cartridge 20K, an electrostatic latent image for the black component is formed on the photoconductor 21K.

Thereafter, the respective surfaces of the photoconductors 21Y, 21M, 21C, and 21K carrying the electrostatic latent images further move in the direction B and opposite the development devices 23Y, 23M, 23C, and 23K. In a development process, the development devices 23Y, 23M, 23C, and 23K respectively supply the photoconductors 21Y, 21M, 21C, and 21K with yellow, magenta, cyan, and black toner supplied from the toner suppliers 32Y, 32M, 32C, and 32K, so that the latent images formed on the photoconductors 21Y, 21M, 21C, and 21K are developed.

After the development process, the respective surfaces of the photoconductors 21Y, 21M, 21C, and 21K further move in the direction B and opposite the transfer-fixing belt 27. The transfer-fixing belt 27, serving as a transfer-fixing member, is looped over the rollers 28A, 28B, and 28C, and the equalizing roller 85 and supported by them. The transfer bias rollers 24 respectively oppose the photoconductors 21Y, 21M, 21C, and 21K via the transfer-fixing belt 27 while contacting an inner circumferential surface of the transfer-fixing belt 27. In a first transfer process, the images (e.g., toner images) in yellow, magenta, cyan, and black formed on the photoconductors 21Y, 21M, 21C, and 21K are sequentially transferred and superimposed on the transfer-fixing belt 27.

After the first transfer process, the respective surfaces of the photoconductors 21Y, 21M, 21C, and 21K move further in the direction B and opposite the cleaners 25. In a cleaning process, the cleaners 25 collect residual toner not transferred and remaining on the photoconductors 21Y, 21M, 21C, and 21K, respectively.

When the respective surfaces of the photoconductors 21Y, 21M, 21C, and 21K pass through dischargers (not shown), one series of image forming processes performed on the photoconductors 21Y, 21M, 21C, and 21K is finished.

As illustrated in FIG. 1, the surface of the transfer-fixing belt 27 carrying the toner image in which yellow, magenta, cyan, and black toner images are superimposed moves in a direction C to a position (e.g., a nip portion) where the transfer-fixing belt 27 contacts the pressing roller 68, serving as a pressing member. According to the present example embodiment, the transfer-fixing device 66 does not includes a device for directly heating the transfer-fixing belt 27, or includes a device for heating the transfer-fixing belt 27 with only a small amount of heat. In a transfer and fixing process, the toner image carried by the transfer-fixing belt 27 is transferred and fixed on a transfer-fixing surface (e.g., a front surface) of a recording medium P (e.g., a transfer paper) at the nip portion formed between the roller 28A and the pressing roller 68. Specifically, after the transfer-fixing surface of the recording medium P is heated by the heating device 67 immediately in front of the nip portion, the toner image is heated and melted with heat onto the transfer-fixing surface at the nip portion, and fixed to the transfer-fixing surface with pressure generated at the nip portion. A structure and operation of the transfer-fixing device 66 are described later in further detail with reference to FIGS. 2 and 3.

Thereafter, the surface of the transfer-fixing belt 27 moves to the belt cleaner 29. When the belt cleaner 29 collects adherents including residual toner remaining on the transfer-fixing belt 27, the transfer and fixing process performed on the transfer-fixing belt 27 is finished.

The recording medium P is stored in the paper tray 61, and conveyed to the nip portion formed between the pressing roller 68 and the transfer-fixing belt 27 via the conveyance guide 63, the registration roller pair 64, and the heating device 67.

Specifically, when the feed roller 62 feeds the recording medium P from the paper tray 61, the conveyance guide 63 guides the recording medium P to the registration roller pair 64. The recording medium P is conveyed from the registration roller pair 64 toward the nip portion formed between the pressing roller 68 and the transfer-fixing belt 27 at a time when the toner image carried by the transfer-fixing belt 27 moves to the nip portion. Before the recording medium P reaches the nip portion, the heating device 67 heats the transfer-fixing surface of the recording medium P.

When the recording medium P bearing a fixed full-color toner image passes through a discharge path (not shown) and is discharged to an outside of the image forming apparatus 100 as an output image by the discharge roller pair 80, one series of image forming processes is completed.

The controller 90 controls operations of the image forming apparatus 100.

A desirable toner used in the image forming apparatus 100 according to the above-described example embodiment is one that is suitable for low temperature fixation. Specifically, a softening point of the toner (e.g., ½ melting temperature) may be about 100 degrees centigrade.

Examples of a toner binder resin may include, but are not limited to, homopolymers of styrene and styrene substitution (e.g., polyester, polystyrene, poly-p-chlorostyrene, and polyvinyl toluene), and styrene copolymers (e.g., a styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer).

Mixtures of resins (e.g., polymethyl methacrylate, polybutyl methacrylate, polyvinyl chloride, polyvinyl acetate, polyethylene, polypropylene, polyurethane, polyamide, epoxide resin, polyvinyl butyral, polyacrylic acid resin, rosin, modified rosin, terpene resin, phenol resin, aliphatic or alicyclic hydrocarbon resin, aromatic system petroleum resin, chlorinated paraffin, and paraffin wax) may be used. In particular, polyester resin may be included in a binder resin since polyester resin may firmly fix toner. Crystalline polyester resin is more desirable since it properly softens and melts when coming into contact with paper, thereby forming an image with sufficient toner fixation and proper color reproduction. The polyester resin may be obtained from condensation polymerization between an alcohol and a carboxylic acid. Examples of the alcohol may include, but are not limited to, diols (e.g., polyethylene glycol, diethylene glycol, triethylene glycol, 1,2-propylene glycol, 1,3-propylene glycol, 1,4-butanediol, neopentyl glycol, and 1,4-butenediol), etherified bisphenols (e.g., 1,4-bis(hydroxymethyl)cyclohexane, bisphenol A, hydrogenated bisphenol A, polyoxyethylenated bisphenol A, and polyoxypropylenated bisphenol A), dihydric alcohols obtained by substituting the above with a saturated or an unsaturated hydrocarbon group having 3 to 22 carbon atoms, and other dihydric alcohols.

The carboxylic acid may include, but is not limited to, maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, divalent organic acid monomers obtained by substituting the above with a saturated or an unsaturated hydrocarbon group having 3 to 22 carbon atoms, and acid anhydrides thereof, dimers of a lower alkyl ester and linoleic acid, and other divalent organic acid monomers.

In order to obtain the polyester resin used as a binder resin, polymers including polyfunctional monomers having not less than three functions may be used as well as the above polymers containing bifunctional monomers. Examples of the polyalcohol monomer having three or more valences may include sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a polycarboxylic acid monomer having three or more valences may include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, trimetric acid, and acid anhydrides thereof.

In order to improve a releasing property of the toner on the surface of the transfer-fixing belt 27 in the transfer and fixing process, the toner used in the image forming apparatus 100 according to the above-described example embodiment may include a release agent. Known release agents may be used, and especially free fatty acid-type carnauba wax, montan wax, oxidized rice wax, and ester wax may be used alone or in combination. The carnauba wax may have a microcrystal structure, an acid value of not greater than about 5 mgKOH/g, and a particle diameter of not greater than about 1 μm when dispersed in a toner binder. The montan wax generally refers to a purified mineral wax, and also may have a microcrystal structure and an acid value ranging from about 5 mgKOH/g to about 14 mgKOH/g. The oxidized rice wax is obtained by oxidizing a rice bran wax with air, and may have an acid value ranging from about 10 mgKOH/g to about 30 mgKOH/g. When each of the acid values of the above waxes does not reach the above range, a temperature of toner fixation increases, causing insufficient low temperature fixation. On the contrary, when each of the acid values exceeds the above range, a cold offset temperature increases, also causing insufficient low temperature fixation.

An amount of wax added to the binder resin may be in a range of from about 1 to about 15 parts by weight per 100 parts by weight of the binder resin included in the toner, and preferably from about 3 to about 10 parts by weight. When the amount of wax is less than about 1 part by weight, there is little releasing effect. Alternatively, when the amount of wax exceeds about 15 parts by weight, toner particles may adhere to carriers.

Further, in order to improve toner fluidity, silica, titanium oxide, alumina, and/or the like, may be added as an additive. If necessary, fatty acid metallic salts, polyvinylidene fluoride, and/or the like, may be added as well.

Figure 2:
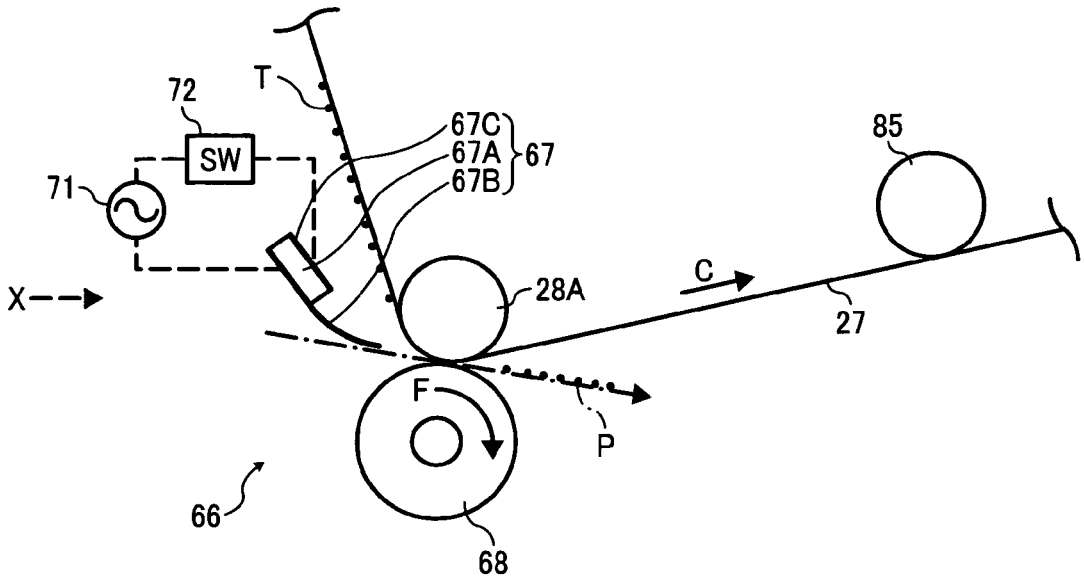
FIG. 2 is a partial schematic enlarged view (according to an example embodiment) of a transfer-fixing device included in the image forming apparatus shown in FIG. 1.
Figure 3:
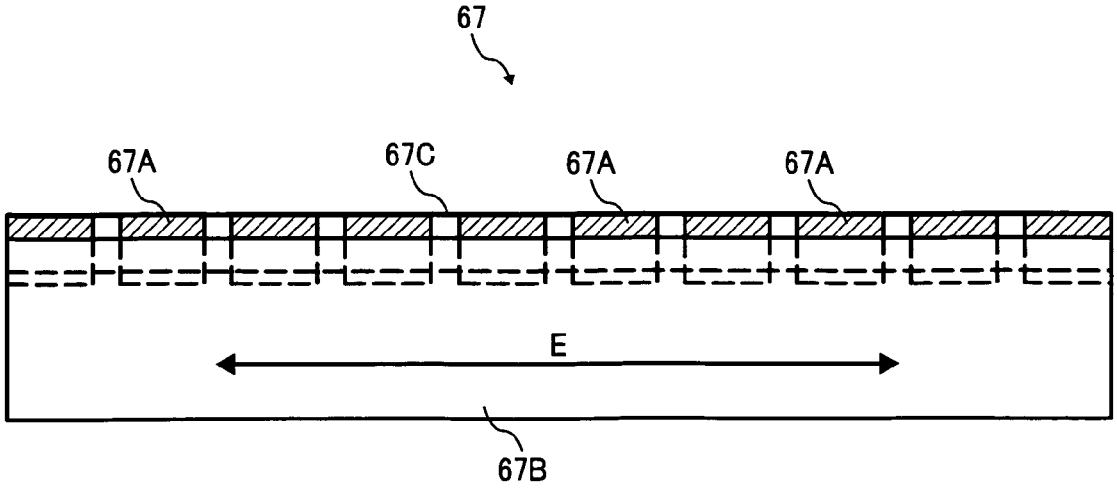
FIG. 3 is a schematic side view (according to an example embodiment) of a heating device included in the transfer-fixing device shown in FIG. 2.

Referring to FIGS. 2 and 3, a description is now given of the transfer-fixing device 66. FIG. 2 is a partial schematic enlarged view of the transfer-fixing device 66. FIG. 3 is a schematic side view of the heating device 67 seen from a direction X in a width direction.

As illustrated in FIGS. 2 and 3, the transfer-fixing device 66 further includes an alternating-current source 71 and/or a switch 72. The heating device 67 includes heating bodies 67A, a heat transfer plate 67B, and/or an electrode 67C.

The endless transfer-fixing belt 27, serving as a transfer-fixing member, includes a multilayered structure in which an elastic layer and a releasing layer are sequentially laminated on a base layer. The base layer includes a polyimide resin with a thickness of about 40 μm. The elastic layer conforms to irregularities in a surface of the recording medium P and includes a rubber material with a thickness of about 60 μm. The releasing layer ensures good releasing property of toner on the surface of the transfer-fixing belt 27 and includes a fluorine resin with a thickness of about 6 μm.

The pressing roller 68 has a structure in which a surface layer (e.g., a releasing layer) is formed on a cylindrical core metal including aluminum and rotates clockwise (e.g., in a direction F). The pressing roller 68 presses the transfer-fixing belt 27 against the roller 28A with a pressing mechanism (not shown), thereby forming a nip portion between the pressing roller 68 and the transfer-fixing belt 27.

The surface layer of the pressing roller 68 may include PTFE (polytetrafluoroethylene), PFA (tetrafluoroethylene-perfluoroalkyl vinyl ether copolymer), and EFP (tetrafluoroethylene-hexafluoropropylene copolymer).

The heating device 67 is provided in front of (e.g., near and upstream from) the nip portion formed between the pressing roller 68 and the transfer-fixing belt 27 in a conveyance direction of a recording medium P. The heating bodies 67A (e.g., heaters) are sandwiched between the heat transfer plate 67B, serving as a heat transfer member, and the electrode 67C. According to the example embodiment, a resistance heating element whose resistance sharply increases at a predetermined Curie point is used as the heating body 67A. For example, a positive character thermistor including a barium titanate semiconductor ceramic element is used as the heating body 67A. Ten heating bodies 67A are provided in a width direction E as illustrated in FIG. 3.

The heat transfer plate 67B, serving as a heat transfer member, includes stainless steel with a thickness of about 0.2 mm. As illustrated in FIG. 2, one end of the heat transfer member 67B contacts the transfer-fixing surface (e.g., the front surface) of the recording medium P conveyed to the nip portion. Therefore, the heat transfer member 67B transfers heat generated in the heating bodies 67A to the transfer-fixing surface of the recording medium P. In addition, the heat transfer plate 67B is connected to the alternating-current source 71, and thus the heat transfer plate 67B also functions as one electrode.

The alternating-current source 71 is connected to the electrode 67C and the heat transfer plate 67B. When the alternating-current source 71 is connected to the switch 72, both ends of the heating bodies 67A, sandwiched between the electrode 67C and the heat transfer plate 67B, are supplied with an AC (alternating current) voltage of about 100 V, thereby sending an electrical current through the heating bodies 67A to heat the heating bodies 67A. Then, heat produced in the heating bodies 67A is transmitted to the transfer-fixing surface of the recording medium P via the heat transfer plate 67B.

The heating body 67A may have a Curie point lower than an ignition temperature of the recording medium P, thereby preventing the heating body 67A from having a higher temperature than the ignition point of the recording medium P with its self-temperature control mechanism.

Specifically, according to the present example embodiment, the Curie point of the heating body 67A is set to about 200 degrees centigrade. Therefore, when the temperature of the heating body 67A exceeds about 200 degrees centigrade, resistance between the electrode 67C and the heat transfer plate 67B sharply increases, thereby decreasing a size of the electrical current flowing through the heating body 67A. For example, when a temperature of the heating body 67A is about 210 degrees centigrade, the size of the electrical current flowing through the heating body 67A is reduced by about half. When the temperature of the heating body 67A is about 220 degrees centigrade, the size of the electrical current flowing through the heating body 67A is reduced to about one quarter.

The temperature of the heating body 67A increases to from about 190 to about 200 degrees centigrade in about 6 seconds with about 1200 watts of power, but does not exceed about 210 degrees centigrade with its self-temperature control mechanism. Further, according to the present example embodiment, since the heating device 67 includes a plurality of heating bodies 67A respectively performing self-temperature control in the width direction E, a temperature variation of the heating bodies 67A in the width direction E may be within about 10 degrees centigrade.

The heating device 67 heats the transfer-fixing surface (e.g., the front surface) of the recording medium P immediately before the transfer-fixing process as described above. In other words, the recording medium P, of which the transfer-fixing surface is heated by the heating device 67, is conveyed to the nip portion before a temperature of a back surface (e.g., a surface opposite to the transfer-fixing surface) of the recording medium P increases, that is, before heat is transmitted from the transfer-fixing surface to the back surface.

For example, according to the present example embodiment, a time period in which the recording medium P contacts the heat transfer plate 67B of the heating device 67 is set to about 10 ms to about 20 ms, and the recording medium P is set to arrive at the nip portion about 2 ms to about 5 ms after the contact between the recording medium P and the heating device 67.

Therefore, an output image (e.g., a fixed toner image) with a sufficient toner fixation and improved coloring property may be obtained without heating the transfer-fixing belt 27.

The heating device 67 heats the transfer-fixing surface such that a temperature of the transfer-fixing surface of the recording medium P, becomes higher than that of the surface of the transfer-fixing belt 27. Thus, a toner image T carried by the transfer-fixing belt 27 is heated and melted at the nip portion by heat from the recording medium P.

In a conventional color image forming apparatus, in order to gloss the output image, an amount of heat about half as much again as an amount of heat applied in a monochrome image forming apparatus is applied to a transfer-fixing belt in consideration of a decrease in temperature of the transfer-fixing belt due to removal of heat by a recording medium. As a result, the recording medium is overheated, and toner is needlessly adhered to the recording medium.

However, according to the present example embodiment, by heating the transfer-fixing surface of the recording medium P while separately setting a temperature for obtaining a sufficient gloss on the output image, a temperature of the transfer-fixing belt 27 (e.g., a fixing preset temperature) may be decreased. Further, since the recording medium P is heated immediately before the transfer-fixing process, the recording medium P is not excessively heated and toner does not needlessly adhere to the recording medium P.

Therefore, in the transfer-fixing device 66 according to the present example embodiment, low temperature fixation of toner, shortening of a warm-up period of the image forming apparatus 100, and energy conservation may be achieved. Further, transfer of heat to the transfer-fixing belt 27 may be reduced or prevented, thereby improving durability of the transfer-fixing belt 27. Moreover, a heating temperature of the transfer-fixing belt 27 may be decreased, preventing heat deterioration of the transfer-fixing belt 27.

In the transfer-fixing device 66 according to the above-described example embodiment, an amount of heat needed for heating and melting of toner is supplied by efficiently heating the recording medium P immediately before the recording medium P is conveyed to the nip portion, thereby suppressing heating of the transfer-fixing belt 27. However, when the transfer-fixing belt 27 is exposed to a great amount of uneven heat from the heated recording medium P, the temperature may vary in a width direction of the transfer-fixing belt 27 (e.g., a direction perpendicular to the conveyance direction of the recording medium P), thereby resulting in a faulty image with uneven toner fixation, toner offset, and/or the like.

Therefore, as illustrated in FIG. 2, the equalizing roller 85 is provided as a temperature equalizer for equalizing a temperature distribution of the surface of the transfer-fixing belt 27 in the width direction after passing through the nip portion.

The equalizing roller 85 is provided downstream from the nip portion in a direction of movement of the transfer-fixing belt 27 (e.g. the direction C), and stretches and supports the transfer-fixing belt 27 together with the rollers 28A, 28B, and 28C (depicted in FIG. 1). The equalizing roller 85 includes a heat pipe in which heat is efficiently convected to equalize the temperature distribution of the surface of the transfer-fixing belt 27 in the width direction. Therefore, even when the heating device 67 heats the recording medium P immediately before the latter is conveyed to the nip portion while suppressing heating of the transfer-fixing belt 27, a faulty image with uneven toner fixation and toner offset may be reduced or prevented.

According to the above-described example embodiment, the heat pipe is used as the equalizing roller 85. However, the equalizing roller 85 may include a material including a graphite having a great degree of heat conductivity, providing an effect equivalent to that described above.

According to the above-described example embodiment, the transfer-fixing device 66 includes the equalizing roller 85 in addition to three rollers 28A, 28B, and 28C. However, the roller 28B provided downstream from the nip portion in the conveyance direction of the recording medium P may be used as the equalizing roller 85 including a heat pipe.

As described above, according to the above-described example embodiment, by efficiently heating the transfer-fixing surface of the recording medium P immediately before the recording medium P is conveyed to the nip portion formed between the transfer-fixing belt 27, serving as a transfer-fixing member, and the pressing roller 68, serving as a pressing member, and by providing the equalizing roller 85, serving as a temperature equalizer, for equalizing a temperature distribution of the transfer-fixing belt 27 in the width direction after the transfer-fixing process, the image forming apparatus 100 may decrease energy consumption, and reduce or prevent a faulty image with uneven toner fixation.

Further, according to the above-described example embodiment, the heating body 67A of the heating device 67 includes the resistance heating element (e.g., the positive character thermistor). Alternatively, however, a metal for generating heat by electromagnetic induction and having a decreased magnetic permeability at a reference Curie point also may be used as the heating body 67A, providing an advantageous effect equivalent to that of the above-described example embodiment.

Specifically, the heating device 67 may include a plate spring with a thickness of about 0.3 mm including a magnetic shunt alloy including nickel, iron and an induction coil opposite to the plate spring. Like the heat transfer plate 67B, a top end of the plate spring contacts the recording medium P conveyed to the nip portion. Therefore, upon application of a high-frequency voltage of about 20 kHz to the induction coil, the plate spring is heated by electromagnetic induction and transmits heat to the transfer-fixing surface of the recording medium P. Further, the plate spring has a ratio of nickel to the magnetic shunt alloy of about 40 percent. As magnetic permeability sharply decreases at a Curie point of about 200 degrees centigrade, the plate spring may not be heated by electromagnetic induction. For example, a temperature of the heating body 67A increases to from about 190 degrees centigrade to about 200 degrees centigrade in about three seconds with about 1200 watts of power, but does not exceed about 210 degrees centigrade with its self-temperature control mechanism.

Figure 4:
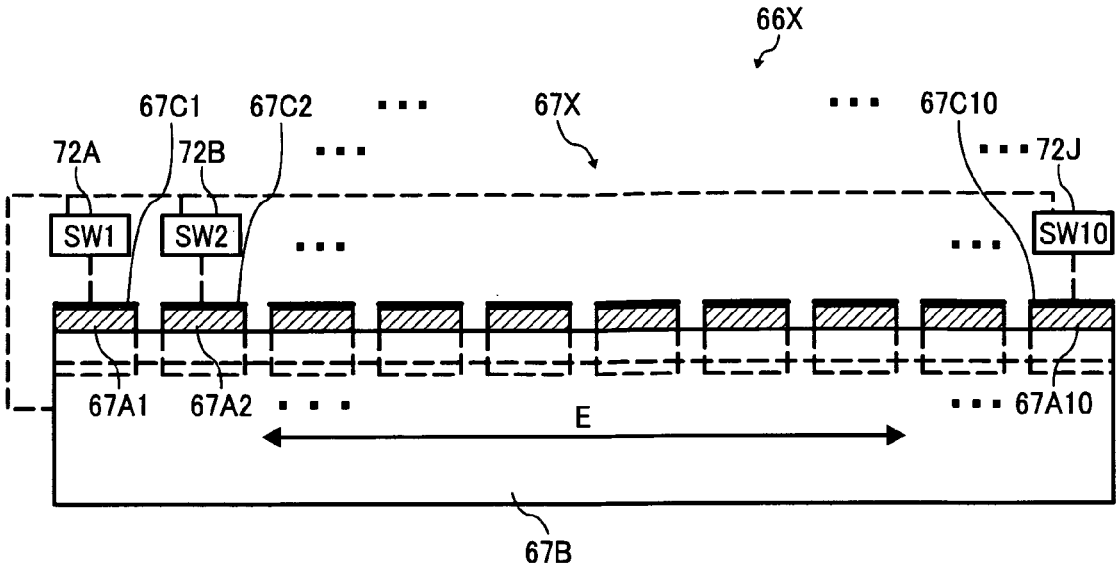
FIG. 4 is a schematic side view of a heating device according to another example embodiment of the present invention.

Referring to FIG. 4, a description is now given of a transfer-fixing device 66X according to another example embodiment. FIG. 4 is a schematic side view of a heating device 67X of the transfer-fixing device 66X seen in a width direction. The heating device 67X includes ten heating bodies 67A1 to 67A10, ten electrodes 67C1 to 67C10, and ten switches 72A to 72J. The other elements of the transfer-fixing device 66X are identical to those of the transfer-fixing device 66 depicted in FIG. 2.

As illustrated in FIG. 4, ten heating bodies 67A1 to 67A10 and ten electrodes 67C1 to 67C10 are dispersed in the width direction E. The heating bodies 67A1 to 67A10 and the electrodes 67C1 to 67C10 are connected to the independently controllable switches 72A to 72J, respectively.

Based on image information transmitted to the controller 90 (depicted in FIG. 1) of the image forming apparatus body 1, an image region on an image surface (e.g., the transfer-fixing surface) is heated while a non-image region is not heated. For example, the heating bodies 67A1 to 67A10 corresponding to the image region in which an image is formed are selectively connected to the corresponding switches 72A to 72J to start heating, while the heating bodies 67A1 to 67A10 corresponding to the non-image region in which no image is formed are selectively disconnected to stop heating.

Therefore, the heating device 67X may be prevented from wasting power, and even when there is background fouling (a phenomenon in which toner particles adhere to the non-image region) on the transfer-fixing belt 27, the fouling toner particles may not be transferred and fixed on the recording medium P at the nip portion.

By using the transfer-fixing device 66X according to the present example embodiment, temperature irregularity of the surface of the transfer-fixing belt 27 in a width direction before and after passing through the equalizing roller 85 is measured by thermography. The temperature of the surface of the transfer-fixing belt 27 in the width direction before passing through the equalizing roller 85 ranges from about 30 to about 40 degrees centigrade, while the temperature of the surface of the transfer-fixing belt 27 in the width direction after passing through the equalizing roller 85 varies by less than about 10 degrees centigrade. Even when sheets of a recording medium are fed continuously, a faulty image with uneven gloss, insufficient toner fixation, and/or the like, does not occur, and instead a high-quality output image may be stably formed.

As in the above-described previous example embodiment, according to the present example embodiment, by efficiently heating the transfer-fixing surface of the recording medium P immediately before the recording medium P is conveyed to the nip portion formed between the transfer-fixing belt 27 and the pressing roller 68 and by providing the equalizing roller 85 for equalizing a temperature distribution of the transfer-fixing belt 27 in the width direction after the transfer-fixing process, the image forming apparatus 100 may decrease energy consumption, and a faulty image with uneven toner fixation may be reduced or prevented.

Figure 5:
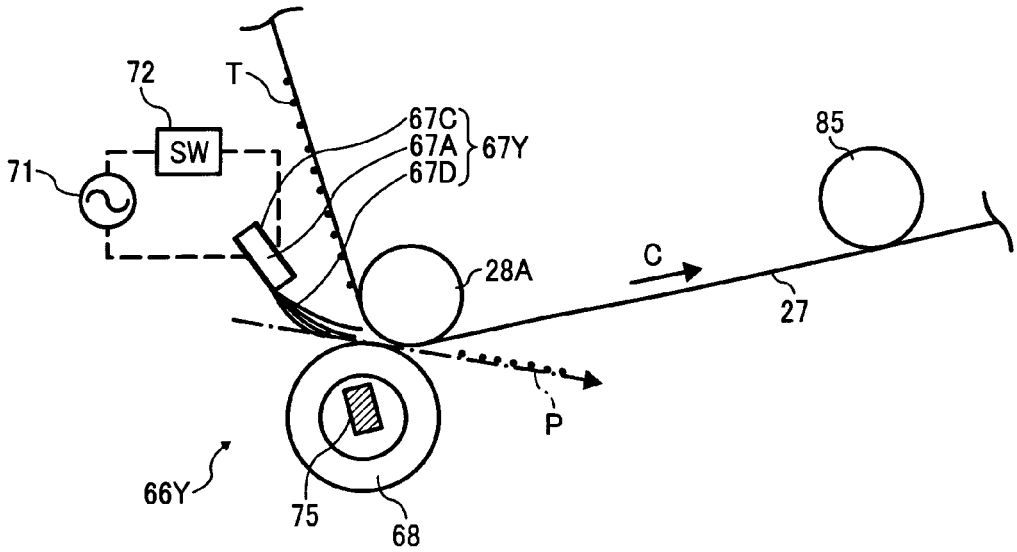
FIG. 5 is a partial schematic enlarged view of a transfer-fixing device according to yet another example embodiment of the present invention.

Referring to FIG. 5, a description is now given of a transfer-fixing device 66Y according to yet another example embodiment. FIG. 5 is a schematic partial enlarged view of the transfer-fixing device 66Y. The transfer-fixing device 66Y includes a magnet 75 and a heating device 67Y. The heating device 67Y includes the heating bodies 67A, the electrode 67C, and/or a brush-like member 67D.

Instead of the heat transfer plate 67B, the heating device 67 includes the brush-like member 67D as a heat transfer member. The brush-like member 67D has a magnetic property and contacts the transfer-fixing surface of the recording medium P to transfer heat thereto. The magnet 75, serving as a magnetic force generator, is provided in the pressing roller 68 and opposes the brush-like member 67D. The other elements of the transfer-fixing device 66Y are equivalent to those of the transfer-fixing device 66 depicted in FIG. 2.

The magnet 75 applies a magnetic force causing the brush-like member 67D to contact the recording medium P. Therefore, the brush-like member 67D may stably contact the recording medium P over time. That is, repeated contact with the recording medium P causing bending of bristles of the brush-like member 67D and insufficient heating of the recording medium P due to a contact failure may be reduced or prevented.

For example, the brush-like member 67D may include a bundle of fibers with an outer diameter of about 40 μm including SUS304. SUS304 is austenitic stainless steel and generally a nonmagnetic material, but shows a magnetic property after being drawn like a fiber or a foil. In addition to SUS304, a fiber including a ferrite series material originally having a magnetic property, a fiber including nickel, and/or the like, may be used as a material of the brush-like member 67D.

An evaluation test of the transfer-fixing device 66Y was performed by using Sabre-X80 paper as a recording medium P. Sabre-X80 paper has a large surface irregularity and a degree of smoothness of below 23 seconds.

The "degree of smoothness" measured in seconds represents surface irregularities of the recording medium P (e.g., a sheet), and is determined based on a paper testing method No. 5-74 of Japan Technical Association of the Pulp and Paper Industry. When a sheet has a higher degree of smoothness, the sheet becomes smoother and has less surface irregularities. An available plain sheet having a degree of smoothness of above 30 seconds is used in an electrophotographic image forming apparatus in Japan. A high-quality sheet has a degree of smoothness exceeding 100 seconds. A sheet having a degree of smoothness below 30 seconds is hardly available except for some types of sheets available in other countries, a special sheet used for a book cover, and/or the like.

When the recording medium P was conveyed to the transfer-fixing device 66Y, the bristles of the brush-like member 67D contacted the recording medium P without bending. Accordingly, the transfer-fixing device 66Y provided a stable fixing performance.

As in the above-described previous example embodiments, according to the present example embodiment, by efficiently heating the transfer-fixing surface of the recording medium P immediately before the recording medium P is conveyed to the nip portion formed between the transfer-fixing belt 27 and the pressing roller 68 and by providing the equalizing roller 85 for equalizing a temperature distribution of the transfer-fixing belt 27 in the width direction after the transfer-fixing process, the image forming apparatus 100 may decrease energy consumption, and a faulty image with uneven toner fixation may be reduced or prevented.

Especially in the present example embodiment, since the heating device 67Y includes the brush-like member 67D, serving as a heat transfer member, even the transfer-fixing surface of the recording medium P with large irregularities and a low degree of smoothness may be evenly and properly heated.

Figure 6:
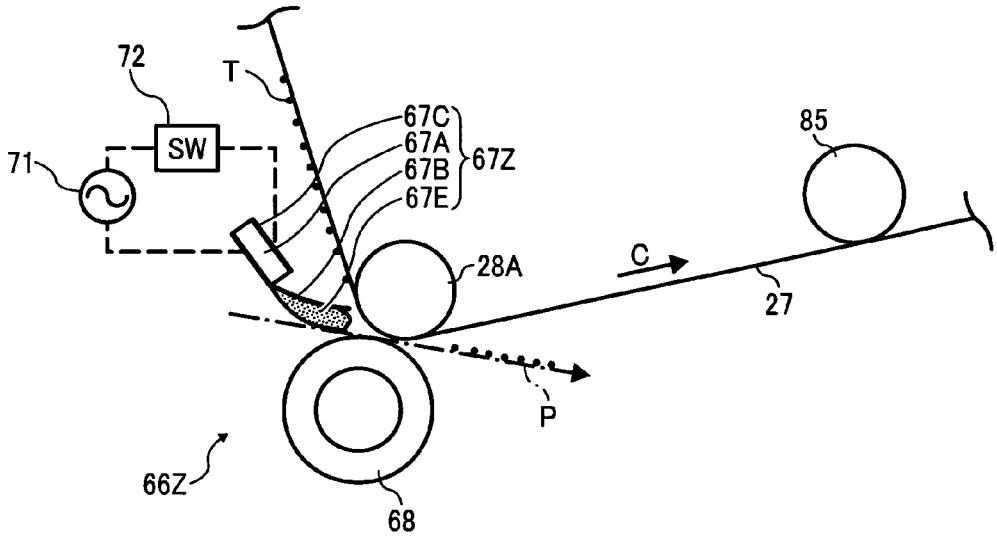
FIG. 6 is a partial schematic enlarged view of a transfer-fixing device according to yet another example embodiment of the present invention.

Referring to FIG. 6, a description is now given of a transfer-fixing device 66Z according to yet another example embodiment. FIG. 6 is a schematic partial enlarged view of the transfer-fixing device 66Z. The transfer-fixing device 66Z includes a heating device 67Z. The heating device 67Z includes the heating bodies 67A, the heat transfer plate 67B, the electrode 67C, and/or a pouch-like member 67E.

As well as the heat transfer plate 67B, the pouch-like member 67E serves as a heat transfer member. As illustrated in FIG. 6, the pouch-like member 67E is provided on an edge portion of the heat transfer plate 67B and contacts the transfer-fixing surface of the recording medium P conveyed to the nip portion to transmit heat thereto. The other elements of the transfer-fixing device 66Z are identical to those of the transfer-fixing device 66 depicted in FIG. 2.

The pouch-like member 67E includes a flexible thin film material with increased strength obtained by drawing a fluoroethylene resin, for example, PTFE (polytetrafluoroethylene) and having a thickness of about 10 μm. The pouch-like member 67E stores a powder having a heat resistance property. The powder may include a copper powder with a great heat conductivity having an average particle diameter of about 10 μm and a ceramic powder so as to quickly transmit heat from the heating body 67A to the recording medium P.

Accordingly, heat is transmitted from the heating body 67A to the transfer-fixing surface of the recording medium P via the heat transfer plate 67B and the pouch-like member 67E.

Since the pouch-like member 67E includes a flexible thin film material, the pouch-like member 67E may conform to irregularities of the surface of the recording medium P when coming into contact with the recording medium P. The heating device 67Z may evenly heat a recording medium P with large irregularities and a decreased degree of smoothness.

Further, since the pouch-like member 67E has a low surface friction coefficient, the recording medium P may be smoothly conveyed while toner particles hardly accumulate in the pouch-like member 67E nor transfer to the pouch-like member 67E.

According to the present example embodiment, the pouch-like member 67E includes a thin film material including a fluoroethylene resin, however, the pouch-like member 67E may include a metal foil, for example, a nickel, stainless, and/or the like, so that the pouch-like member 67E has enhanced heat conductivity.

As in the above-described previous example embodiments, according to the present example embodiment, by efficiently heating the transfer-fixing surface of the recording medium P immediately before the recording medium P is conveyed to the nip portion formed between the transfer-fixing belt 27 and the pressing roller 68 and by providing the equalizing roller 85 for equalizing a temperature distribution of the transfer-fixing belt 27 in the width direction after the transfer-fixing process, the image forming apparatus 100 may decrease energy consumption, and a faulty image with uneven toner fixation may be reduced or prevented.

The powder stored in the pouch-like member 67E may include a magnetic powder, for example, a ferrite powder having an average particle diameter of about 20 μm so that the pouch-like member 67E is caused to contact the recording medium P by magnetic force of the magnet 75 (depicted in FIG. 5) like the above-described previous example embodiment.

An evaluation test of the transfer-fixing device 66Z was performed by using Badger Bond/Offset 16 lb paper as a recording medium P. Badger Bond/Offset 16 lb paper has a degree of smoothness of below 16 seconds. When the recording medium P was conveyed to the transfer-fixing device 66Z, the pouch-like member 67E conformed to a surface of the recording medium P. Accordingly, the transfer-fix device 66Z provided a stable fixing performance.

Instead of storing the heat resistant powder in the pouch-like member 67E, the pouch-like member 67E may store a liquid or a gel having a heat resistance property.

An evaluation test of the transfer-fixing device 66Z was performed by using a back surface of Sazanami FC Japanese paper having a smoothness of below 8 seconds. When the recording medium P was conveyed to the transfer-fixing device 66Z, the pouch-like member 67E conformed to the back surface of the recording medium P. Accordingly, the transfer-fixing device 66Z provided a stable fixing performance.

The pouch-like member 67E may store a magnetic powder, for example, a ferrite powder as well as silicone oil so that the pouch-like member 67E may contact the recording medium P by magnetic force of the magnet 75 (depicted in FIG. 5) as in the previous example embodiment.

An evaluation test of the transfer-fixing device 66Z was performed by using a front surface of Sazanami FC Japanese paper having a smoothness of below 5 seconds. When the recording medium P was conveyed to the transfer-fixing device 66Z, the pouch-like member 67E conformed to the front surface of the recording medium P. Accordingly, the transfer-fixing device 66Z provided a stable fixing performance.

Figure 7:
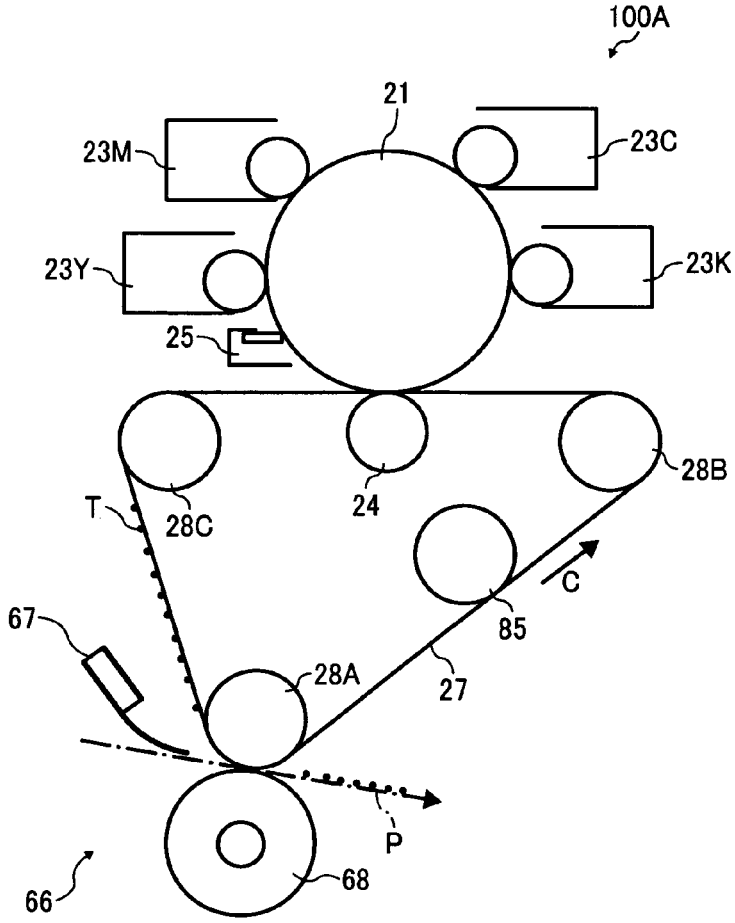
FIG. 7 is a partial schematic view of an image forming apparatus according to yet another example embodiment of the present invention.

Referring to FIG. 7, a description is now given of an image forming apparatus 100A according to yet another example embodiment. FIG. 7 is a schematic partial view of the image forming apparatus 100A.

The image forming apparatus 100A includes a photoconductor 21, development devices 23Y, 23M, 23C, and 23K, a cleaner 25, and/or a transfer-fixing device 66. The transfer-fixing device 66 includes a transfer-fixing belt 27, a heating device 67, a pressing roller 68, an equalizing roller 85, rollers 28A, 28B, and 28C, and/or a transfer bias roller 24.

Around the photoconductor 21 are provided a writing device for yellow, magenta, cyan, and black (not shown), a charging device (not shown), the development devices 23Y, 23M, 23C, and 23K, and the cleaner 25. A toner image in each color is formed on the photoconductor 21 and superimposed on another toner image. When the superimposed toner image opposes the transfer bias roller 24, the image is transferred to the transfer-fixing belt 27.

As in the above-described previous example embodiments, the toner image T carried by the transfer-fixing belt 27 is transferred and fixed on a recording medium P heated by the heating device 67 at the nip portion formed between the pressing roller 68 and the transfer-fixing belt 27.

Like the above-described previous example embodiments, according to the present example embodiment, by efficiently heating the transfer-fixing surface of the recording medium P immediately before the recording medium P is conveyed to the nip portion formed between the transfer-fixing belt 27 and the pressing roller 68 and by providing the equalizing roller 85 for equalizing a temperature distribution of the transfer-fixing belt 27 in the width direction after the transfer-fixing process, the image forming apparatus 100A may decrease energy consumption, and a faulty image with uneven toner fixation may be reduced or prevented.

The present invention has been described above with reference to specific example embodiments. Nonetheless, the present invention is not limited to the details of example embodiments described above, but various modifications and improvements are possible without departing from the spirit and scope of the present invention. The number, position, shape, and the like, of the above-described constituent elements are not limited to the above-described example embodiments, but may be modified to the number, position, shape, and the like, which are appropriate for carrying out the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A transfer-fixing device for transferring a toner image to a transfer-fixing surface of a recording medium and fixing the toner image on the recording medium, the transfer-fixing device comprising:

a transfer-fixing member to carry the toner image;

a pressing member to press against the transfer-fixing member at a support roller to form a nip portion to which the recording medium is conveyed;

a heating device to heat the transfer-fixing surface of the recording medium conveyed toward the nip portion, the heating device including a plurality of heating bodies spaced apart in a width direction thereof such that the heating device selectively heats an image region on the surface of the transfer-fixing member;

a temperature equalizer to equalize a temperature distribution of a surface of the transfer-fixing member in a width direction of the transfer-fixing member after the surface of the transfer-fixing member passes through the nip portion, the temperature equalizer contacts the transfer-fixing member in an area where the transfer-fixing member is not in contact with the pressing member and the support roller forming the nip; and a magnetic force generator to generate magnetic force, wherein the heating device includes a brush-like member to have a magnetic property and contact the transfer-fixing surface of the recording medium to transfer heat thereto, and the magnetic force generated by the magnetic force generator provides the brush-like member to contact against the recording medium.

2. The transfer-fixing device according to claim 1, wherein the heating device heats the transfer-fixing surface of the recording medium such that the recording medium is conveyed to the nip portion before a temperature of a back surface opposite the transfer-fixing surface of the recording medium increases.

3. The transfer-fixing device according to claim 1, wherein the heating device increases a temperature of the transfer-fixing surface of the recording medium above a surface temperature of the transfer-fixing member.

4. The transfer-fixing device according to claim 1, wherein the heating device comprises a heating body having a Curie point lower than an ignition temperature of the recording medium.

5. The transfer-fixing device according to claim 4, wherein the heating body comprises a resistance heating element whose resistance increases at the Curie point.

6. The transfer-fixing device according to claim 4, wherein the heating body comprises a metal for generating heat by electromagnetic induction and having a decreased magnetic permeability at the Curie point.

7. The transfer-fixing device according to claim 1, wherein the image region on the transfer-fixing surface is heated and a non-image region on the transfer-fixing surface is not heated.

8. A transfer-fixing device for transferring a toner image to a transfer-fixing surface of a recording medium and fixing the toner image on the recording medium, the transfer-fixing device comprising:

a transfer-fixing member to carry the toner image;

a pressing member to press against the transfer-fixing member at a support roller to form a nip portion to which the recording medium is conveyed;

a heating device to heat the transfer-fixing surface of the recording medium conveyed toward the nip portion;

a temperature equalizer to equalize a temperature distribution of a surface of the transfer-fixing member in a width direction of the transfer-fixing member after the surface of the transfer-fixing member passes through the nip portion, the temperature equalizer contacting the transfer-fixing member in an area where the transfer-fixing member is not in contact with the pressing member and support roller forming the nip; and a magnetic force generator to generate magnetic force, wherein the heating device includes a brush-like member to have a magnetic property and contact the transfer-fixing surface of the recording medium to transfer heat thereto, the magnetic force generated by the magnetic force generator contacting the brush-like member against the recording medium.

9. The transfer-fixing device according to claim 4, wherein the heating device comprises a heat transfer member to contact the transfer-fixing surface of the recording medium and transfer heat from the heating body to the transfer-fixing surface of the recording medium, the heat transfer member including a pouch-like member to store a powder having a heat resisting property.

10. The transfer-fixing device according to claim 9, wherein the powder comprises a magnetic powder, the magnetic force generated by the magnetic force generator acting on the magnetic powder causing the pouch-like member to contact the recording medium.

11. The transfer-fixing device according to claim 4, wherein the heating device comprises a heat transfer member to contact the transfer-fixing surface of the recording medium and transfer heat from the heating body to the transfer-fixing surface of the recording medium, the heat transfer member including a pouch-like member to store a liquid having a heat resisting property.

12. The transfer-fixing device according to claim 4, wherein the heating device comprises a heat transfer member to contact the transfer-fixing surface of the recording medium and transfer heat from the heating body to the transfer-fixing surface of the recording medium, the heat transfer member including a pouch-like member to store a gel having a heat resisting property.

13. The transfer-fixing device according to claim 11, wherein the pouch-like member further stores a magnetic powder, the magnetic force of the magnetic force generator acting on the magnetic powder causing the pouch-like member to contact the recording medium.

14. The transfer-fixing device according to claim 12, wherein the pouch-like member further stores a magnetic powder, the magnetic force of the magnetic force generator acting on the magnetic powder causing the pouch-like member to contact the recording medium.

15. The transfer-fixing device according to claim 1, wherein the temperature equalizer comprises a heat pipe.

16. The transfer-fixing device according to claim 1, wherein the transfer-fixing member comprises a transfer-fixing belt looped over a plurality of rollers.

17. The transfer-fixing device according to claim 16, wherein the temperature equalizer comprises one of the plurality of rollers.

18. An image forming apparatus, comprising:

a transfer-fixing device to transfer a toner image to a transfer-fixing surface of a recording medium and fix the toner image on the recording medium, the transfer-fixing device including, a transfer-fixing member to carry the toner image, a pressing member to press against the transfer-fixing member at a support roller to form a nip portion to which the recording medium is conveyed, a heating device to heat the transfer-fixing surface of the recording medium conveyed toward the nip portion, the heating device includes a plurality of heating bodies spaced apart in a width direction thereof such that the heating device selectively heats an image region on the surface of the transfer-fixing member, and a temperature equalizer to equalize a temperature distribution of a surface of the transfer-fixing member in a width direction of the transfer-fixing member after the surface of the transfer-fixing member passes through the nip portion, the temperature equalizer contacts the transfer-fixing member in an area where the transfer-fixing member is not in contact with the pressing member and the support roller forming the nip; and a magnetic force generator to generate magnetic force, wherein the heating device includes a brush-like member to have a magnetic property and contact the transfer-fixing surface of the recording medium to transfer heat thereto, and the magnetic force generated by the magnetic force generator provides the brush-like member to contact against the recording medium.

19. A transfer-fixing method, comprising:

carrying a toner image with a transfer-fixing member;

forming a nip portion between the transfer-fixing member and a pressing member for pressingly contacting the transfer-fixing member;

heating a transfer-fixing surface of a recording medium conveyed toward the nip portion formed between the transfer-fixing member and the pressing member;

selectively heating an image region on the surface of the transfer-fixing member via a heating device having a plurality of heating bodies spaced apart in a width direction thereof;

transferring the toner image from the transfer-fixing member to the heated transfer-fixing surface of the recording medium at the nip portion;

fixing the toner image on the recording medium with heat and pressure applied to the recording medium at the nip portion;

equalizing a temperature distribution of a surface of the transfer-fixing member in a width direction of the transfer-fixing member after the surface of the transfer-fixing member passes through the nip portion, the equalizing reducing a temperature variation in the width direction of the transfer-fixing member to within 10 degrees centigrade, the temperature equalizer contacts the transfer-fixing member in an area where the transfer-fixing member is not in contact with the pressing member and the pressing member forming the nip; and generating a magnetic force, wherein the heating device includes a brush-like member to have a magnetic property and to contact the transfer-fixing surface of the recording medium to transfer heat thereto, the magnetic force generated by the magnetic force generator provides the brush-like member to contact against the recording medium.

20. The transfer-fixing device of claim 19, wherein the equalizing the temperature distribution is performed on the surface of the transfer-fixing member at an area where the transfer-fixing member is not in contact with any member forming the nip portion.

* * * * *